United States Patent [19]

Li

[11] Patent Number: 4,538,871

[45] Date of Patent: Sep. 3, 1985

[54] SET OF PLUG WITH L-SHAPED PINS AND CORRESPONDING SOCKET

[76] Inventor: Chiu-shan Li, No. 133-2, Lane 163, San Ho Rd., Section 4, San Chung City, Taipei Hsien, Taiwan, 241

[21] Appl. No.: 436,666

[22] Filed: Feb. 15, 1983

[51] Int. Cl.[3] ..... H01R 13/62

[52] U.S. Cl. ..... 339/75 M; 339/259 R; 339/189 R

[58] Field of Search ..... 339/119 R, 184, 188, 339/189, 190, 210 R, 210 M

[56] References Cited

U.S. PATENT DOCUMENTS

| | | | |
|---|---|---|---|
| 1,771,729 | 7/1930 | Hubbell | 339/189 R |
| 2,310,024 | 2/1943 | Frank et al. | 339/189 R |
| 2,312,017 | 2/1943 | Ackerman | 339/189 R |
| 2,324,144 | 7/1943 | Faulkner | 339/184 M |
| 2,437,579 | 3/1948 | Wilson | 339/189 R |
| 2,750,572 | 12/1956 | Fox | 339/210 M |
| 2,923,912 | 2/1960 | Benander | 339/210 R |
| 2,924,808 | 2/1960 | Hewes et al. | 339/210 M |
| 3,089,042 | 5/1963 | Hickey et al. | 339/184 R |
| 3,108,842 | 10/1963 | Gorman | 339/119 R |

*Primary Examiner*—Gil Weidenfeld
*Assistant Examiner*—David L. Pirlot
*Attorney, Agent, or Firm*—Holman & Stern

[57] ABSTRACT

An electrical plug and an outlet receptacle therefor wherein the plug pins are "L" shaped and the socket openings are correspondingly shaped to receive the L-shaped pins. The connectors within the outlet are offset from the entrance hole so that the plug has to be moved transversely to the direction of insertion for contact with these connectors.

3 Claims, 21 Drawing Figures

SET OF PLUG WITH L-SHAPED PINS AND CORRESPONDING SOCKET

FIELD OF THE INVENTION

This invention relates to a wall outlet receptacle and plug therefor of the type such as a two prong plug insertable into an electrical power outlet.

BRIEF SUMMARY OF THE INVENTION

In the present invention, the plug has two, or three, L-shaped pins or prongs and the socket in the receptacle of the wall outlet has correspondingly shaped openings and power line contacts positioned so that after insertion of the plug, the plug must be moved in a direction substantially parallel to the wall in order for the pins to engage the contacts.

The object of the present invention is to increase the firmness of the plug due to the L-shaped plug, so the plug in the socket cannot be loosened or slip off from the socket itself as a conventional plug often does.

Another object of the present invention is to make the socket more safe, since the copper pincers are hidden behind the pincers seats and cannot be engaged by a metal wire inserted into the holes, and thus reduces the danger to children who may be playing with the wall outlet.

BRIEF DESCRIPTION OF THE SEVERAL VIEWS OF THE DRAWINGS

The invention will now be described in greater detail with reference to the accompanying drawings wherein.

DETAILED DESCRIPTION

Figure 2:
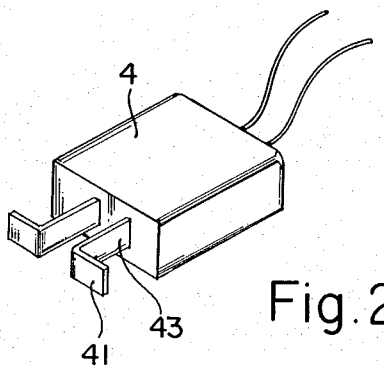
FIG. 2 is a perspective view of the plug of the preferred embodiment of the present invention with the pins bent outwardly.
Figure 1B:
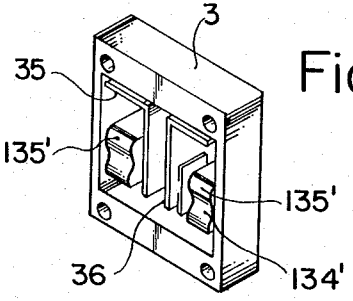
FIG. 1B is a perspective view taken along line 1B—1B of FIG. 1A.
Figure 1A:
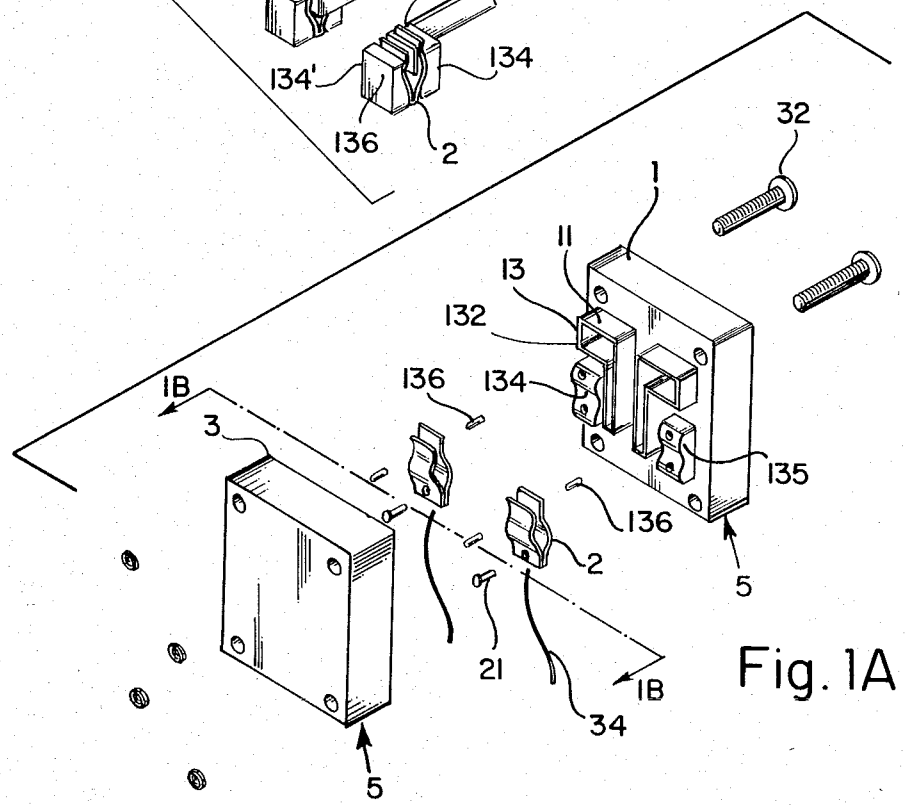
FIG. 1A is an exploded perspective view showing the assembly of the socket of the preferred embodiment of the present invention.
Figure 1C:
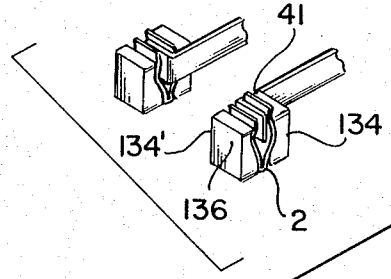
FIG. 1C is a perspective view of the contacts and seats therefor.
Figure 3:
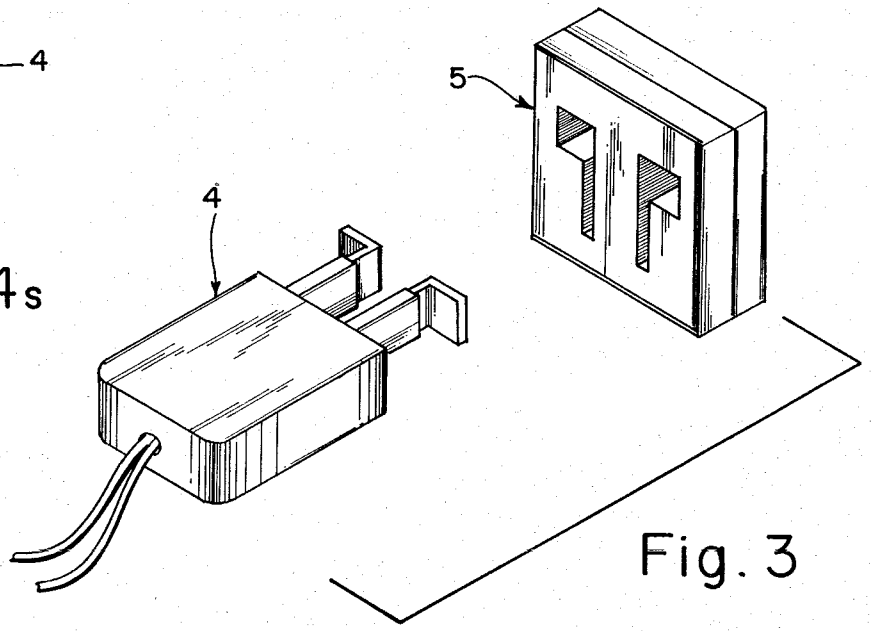
FIG. 3 is a perspective view showing the manner in which the plug of FIG. 2 is inserted in the outlet.
Figure 4S:
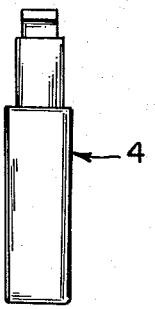
FIGS. 4F, 4T, 4B and 4S are elevational front, top, bottom and side views of the plug of FIG. 2, respectively.
Figure 4T:
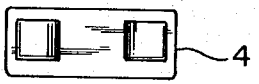
Figure 4F:
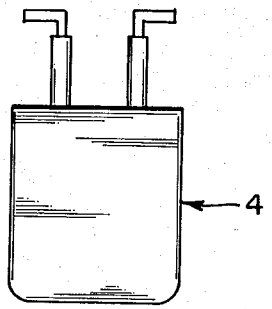
Figure 4B:
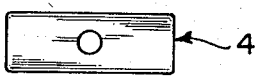

On the seat 1 two plug slots 11 are provided defined by a plug slot piece 13 for each slot 11 to form the pin guiding holes 132. The upper end of each slot 11 is outwardly directed. A trough-shape pincer contact seat 134 is provided beside each plug slot piece 13. A copper pincer contact 2 (the electrical current terminal) with spring force can be fixed on each pincer seat 134 by a screw 21. The outer face of the pincer seats 134 is curved to conform to the contacts 2 (see FIG. 1). On the inner side of the cover 3 are two counterpart pincer seats 134 not shown. In between the two curved pincers seats the two copper pincers 2 are inserted. The electrical wires 34 are attached to the copper pincers. The cover 3 is fastened to seat 1 by four bolts 32 (see FIG. 1). In order to have more durable spring force for the copper pincers 2, a spring can be set in spring hole 135 on the upper part of each pincer seat 134 on the seat 1 as well as on the counterpart pincers seats 134' on the inner side of the cover 3 (not shown in the figures). The corresponding plug 4 with electrical wires is shown in FIG. 2. The pins are L-shaped pins 41 with their upper ends being outwardly bent for use with the socket shown in FIG. 1.

The plug 4 can then be inserted in the socket 5 with the L-shaped pins 41 inserted into the upper part of the plug slots 11 from the back of the seat 1 until the upper face of the plug 4 touches the surface of the socket 5. Then the plug 4 is pushed linearly transversely to the insertion direction downwardly until the upper part of the L-shaped pins 41 slide into the copper pincers 2 to close the circuit.

When it is inserted in this way, the plug 4 can never come loose or slip off from the socket 5 itself due to the upper part of the L-shaped pins 41 being bent and engaged with the copper pincers 2 and pincers seats 134 inside the socket 5. Plugging in the way as described above, due to the weight of the plug 4 and wire themselves, the L-shaped pins 41 can contact with the copper pincers 2 more compactly. Furthermore, since the copper pincers (current terminals) 2 are hidden beside the plug slots 11 and pin guiding holes 132, it is quite safe for anybody, especially a child even if he plays with metal wire inserted into the socket 5. No shock possibility will exist to the child if he does so because the metal wire cannot touch the hidden copper pincers (current terminals) 2.

In addition, insulating material 43 is provided on the lower part of the L-shaped pins (see FIG. 2) for additional safety and protection from shock.

Figure 5:
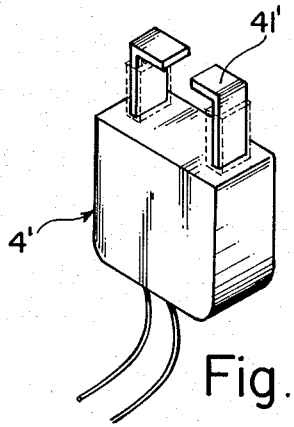
FIG. 5 is a perspective view of a plug with the L-shaped pins bent inwardly.
Figure 6:
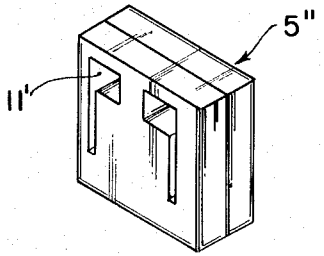
FIG. 6 is a perspective view showing a socket for use with the plug shown in FIG. 5.

FIG. 5 shows the plug 4' with the upper part of the L-shaped pins 41' bent inwardly. FIG. 6 shows the socket 5'' with the inward-bent plug slots 11' for the plugs 4' shown in FIG. 5.

Figure 7B:
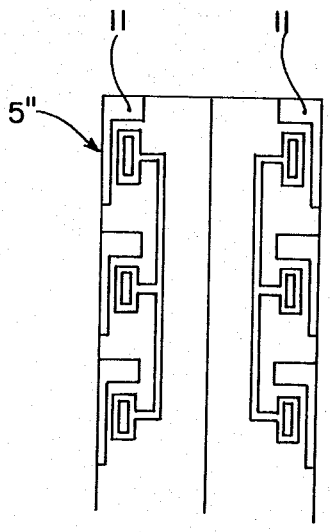
FIGS. 7A and 7B are schematic views of the inner construction of manifold sockets for use with the plugs of FIGS. 2 and 5, respectively.
Figure 7A:
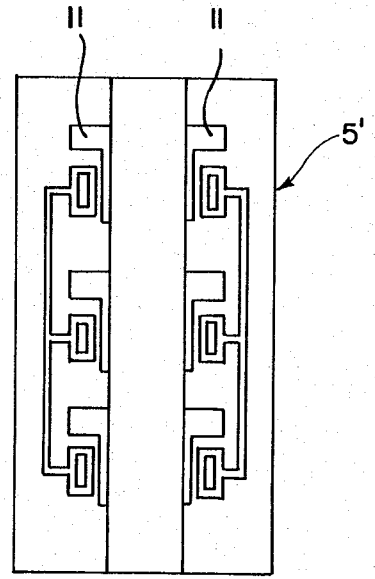

FIG. 7A shows a schematic cross-section of a manifold socket 5' showing its construction inside in detail. Three plugs 4, shown in FIG. 2 (outward-bent pins) can simultaneously plug in. FIG. 7B shows the equivalent of that shown in FIG. 7A but adapted for use with the plug shown in FIG. 5 (inward-bent pins).

Figure 8:
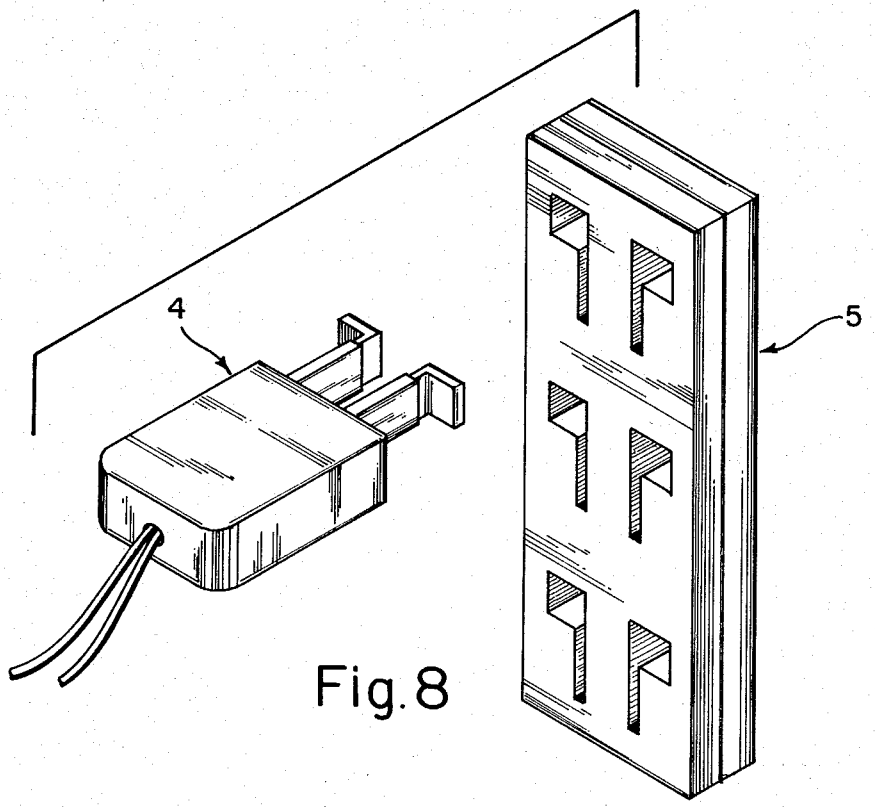
FIG. 8 is a perspective view showing the manner of inserting a plug into a manifold socket.

FIG. 8 shows the manner of inserting the plug of FIG. 2 into the manifold socket 5.

Figure 9:
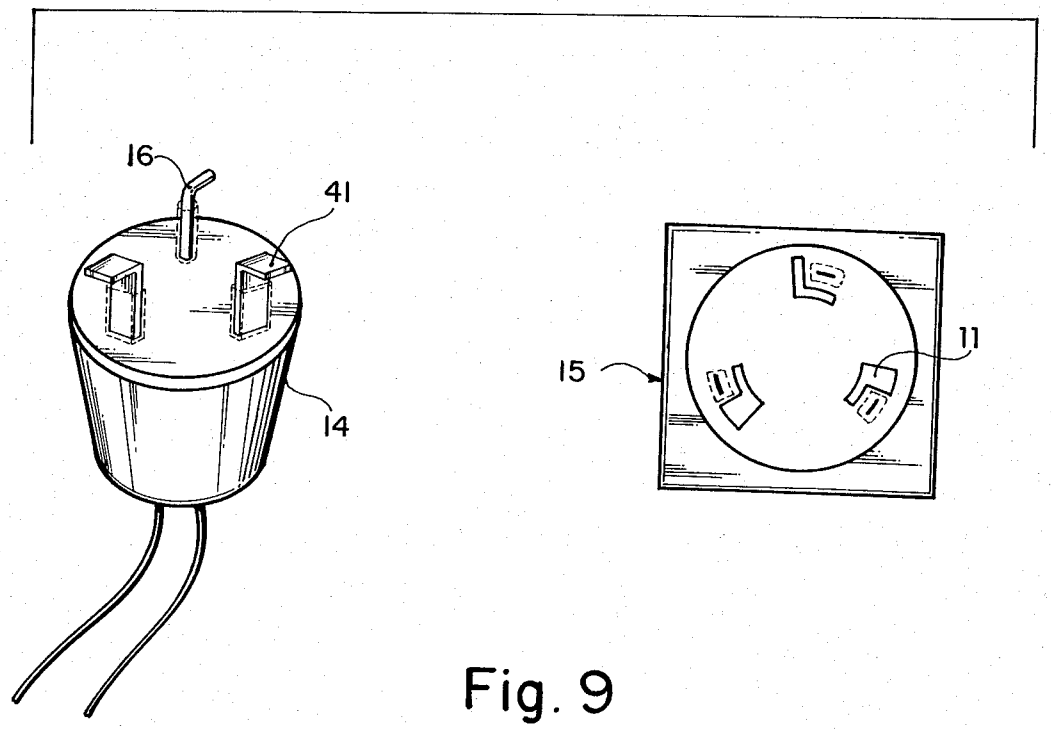
FIG. 9 shows a plug and mating socket for three wires.

FIG. 9 shows the plug 14 and its socket 15 with L-shaped pins 41. After the plug 14 is inserted into the socket 15, the plug is turned clockwise, and thus the circuit is closed. The smallest one of the three pins 16 is a ground wire.

Figure 10:
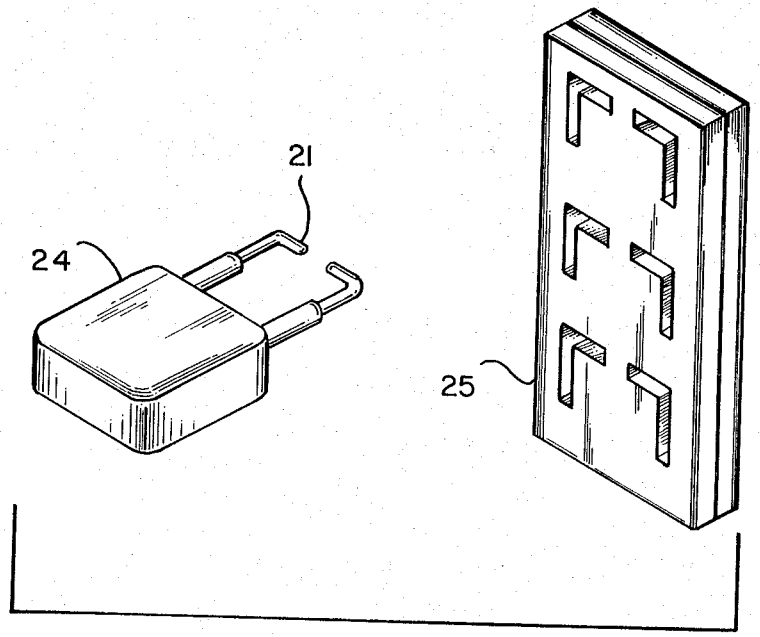
FIG. 10 is a perspective view showing barformed plug pins.
Figure 11R:
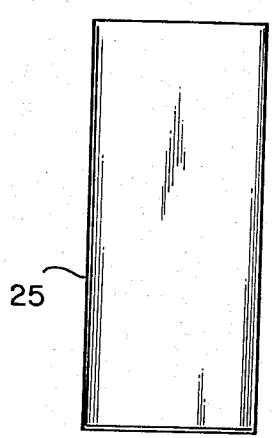
FIGS. 11F, 11T, 11S, 11B, and 11R are the front, top, side, bottom and rear views respectively of the manifold socket of FIG. 10.
Figure 11S:
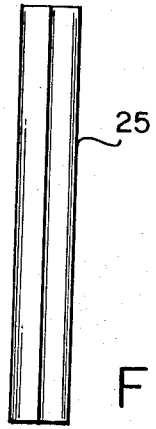
Figure 11F:
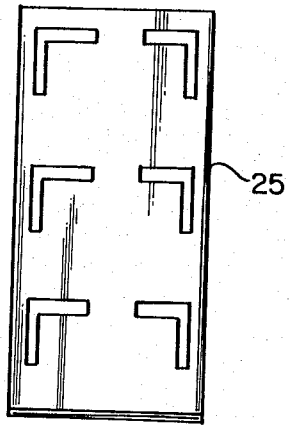
Figure 11T:
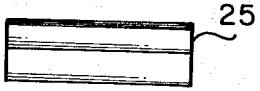
Figure 11B:
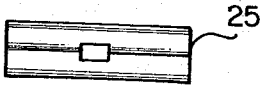

FIG. 10 shows the plug 24 and its manifold socket 25 with the inward-bent pins 21. However, the pins 21 are made by two metal wires instead of plates as shown in FIGS. 1 through 9.

FIGS. 11F, 11T, 11B, 11A and 11S show front, top, bottom, back and side views of a manifold socket 25, respectively.

The unavoidable defect of the conventional plug and socket is that the plug will slip from the socket owing to the elastic fatigue of the copper pincers after much use, and thus the current is cut off. Furthermore, the plug may half slip from the plug slots of the socket, while the circuit is still closed and then a danger of shock will sometimes arise. In this situation, usually the pins of the plug are adjusted further apart or closer together by hand. However, the present invention has no such defect, since the L-shaped pins are hooked inside the socket. This special feature is greatly important to industrial and engineering use since no matter how heavy or how long the wire is, the plug will not slip from the socket itself.

I claim:

1. An electrical plug and socket comprising:

a multi-prong plug wherein the connector prongs are L-shaped members extending from the plug so that one leg of the L extends longitudinally outwardly from said plug and the other leg of the L extends substantially perpendicular to said one leg from the outer end thereof;

a receptacle housing comprised of a hollow back part and a front cover attached to said back part;

L-shaped slots through said cover conforming to said L-shaped prongs having one leg of each slot adapted to receive said other leg of a respective prong inserted therethrough and the other leg of each slot adapted to allow movement of said inserted prongs transversely with respect to the direction of insertion;

a pair of electrical contact seats for each inserted prong comprising a first seat member attached to the inner surface of said cover and a second seat member attached to the inner surface of said back part in cooperative relationship with said first seat member so that when said cover is attached to said back part, said first and second seat members are juxtaposed in relative spaced relationship;

a pair of electrical contacts having a slot opening mounted on each one of said first seat members so that when said first and second seat members are juxtaposed said contacts are held between said seat members; and means to resiliently urge each pair of contacts together so that said slot opening slidingly and resiliently grips said other leg of an inserted respective L-shaped prong;

said seats being positioned with respect to said L-shaped slots so that they are displaced from the inserted ends of said L-shaped prongs when first inserted, but said slot openings in said contacts receive said inserted ends of said prongs when said plug is linearly moved transversely to the direction of insertion and after insertion, so that said plug cannot be withdrawn from said housing and disconnected from said contacts after said linear transverse movement by movement parallel to the direction of insertion.

2. The electrical plug and socket as claimed in claim 1 and further comprising:

an L-shaped shield piece for each L-shaped slot having an L-shaped opening therethrough conforming to the respective slot and projecting from the inside surface of said cover to extend peripherally around said slot;

each shield piece projecting from said cover a sufficient distance inwardly with respect to said electrical contacts to prevent contacting of the electrical contacts by a substantially straight object inserted through said L-shaped slots.

3. The electrical plug and socket as claimed in claim 1 wherein said means to resiliently urge said contacts together comprises:

spring members between said seat members and the adjacent contacts; and spring receiving bore holes in said seat members to cooperatively receive said springs.

* * * * *